US006133698A

United States Patent [19]

Rouhier et al.

[11] Patent Number: 6,133,698

[45] **Date of Patent: *Oct. 17, 2000**

[54] FRACTIONATED-RECTIFICATION HIGH-VOLTAGE TRANSFORMER WITH GROUPED DIODES

[75] Inventors: Bruno Rouhier, Port-sue-Saone; Bernard Millot, St. Apollinaire, both of France

[73] Assignee: Thomson multimedia S.A., Courbevoie, France

[ * ] Notice: This patent issued on a continued prosecution application filed under 37 CFR 1.53(d), and is subject to the twenty year patent term provisions of 35 U.S.C. 154(a)(2).

[21] Appl. No.: 08/666,488

[22] PCT Filed: Oct. 27, 1995

[86] PCT No.: PCT/FR95/01427

§ 371 Date: Nov. 12, 1996

§ 102(e) Date: Nov. 12, 1996

[87] PCT Pub. No.: WO96/14645

PCT Pub. Date: May 17, 1996

[30] Foreign Application Priority Data

Nov. 7, 1994 [FR] France ..... 94 13332

[51] Int. Cl.[7] ..... H01J 29/70; H01F 27/28; H01F 27/29

[52] U.S. Cl. ..... 315/411; 336/182; 336/192

[58] Field of Search ..... 315/411; 363/68, 363/61; 336/182, 220, 192, 107, 208, 211; 338/184, 187, 199; 361/836

[56] References Cited

U.S. PATENT DOCUMENTS

| | | | |
|---|---|---|---|
| 4,293,903 | 10/1981 | Nochida et al. | 315/411 |
| 4,408,176 | 10/1983 | Nakamura | 336/107 |

FOREIGN PATENT DOCUMENTS

| | | |
|---|---|---|
| 0529418 | 7/1989 | European Pat. Off. . |
| 0324084 | 3/1992 | European Pat. Off. . |
| 0475079 | 3/1993 | European Pat. Off. . |
| 58-035910 | 3/1983 | Japan . |
| 2030784 | 4/1980 | United Kingdom . |

OTHER PUBLICATIONS

*Patent Abstracts of Japan, vol. 007, No. 115, May 19, 1983 and Japanese Patent 58–035910 (*see above).

*Primary Examiner*—Gregory C. Issing
*Attorney, Agent, or Firm*—Joseph S. Tripoli; Frederick A. Wein; Daniel E. Sragow

[57] ABSTRACT

The disclosure is a stepped rectification high-voltage transformer including a secondary step-up winding in which at least two output diodes connected to two different stages of this secondary winding are located in a same axial level and perpendicular to the potentiometer block forming part of the insulating casing. The invention is applicable notably to the power supply of television cathode ray tubes.

3 Claims, 5 Drawing Sheets

FRACTIONATED-RECTIFICATION HIGH-VOLTAGE TRANSFORMER WITH GROUPED DIODES

FIELD OF THE INVENTION

The invention concerns a stepped rectification high-voltage (HV) transformer, usable in particular to power cathode ray tubes (CRT) in televisions.

FIELD OF THE INVENTION

The stepped rectification of the high-voltage of the transformer means that the secondary coil of the transformer, known as the step-up coil, includes several HV outputs each of which is rectified by diodes. In the case of the power supply of a CRT of a TV, for example, the HV transformer must supply a high output voltage of about 25 to 35 KV to the anode of the CRT that emits and accelerates the beam of electrons required for operation of the tube, and a high voltage known as the focusing voltage, of the order of 10 to 12 KV, used to regulate the concentration of the beam of electrons in the CRT.

Generally, the secondary coil of the transformer is in the form of a winding on a support of tubular form. This winding is divided axially into at least three stages by at least two diodes that are positioned at the same axial level, that is to say in the same radial plane perpendicular to the axis of the windings, close to front face of the insulating casing of the transformer, this face being generally constituted by a potentiometer block connected to the focusing voltage output. The fact that the rectifying diodes are confined in a small space facing the potentiometer block leads to poor heat dissipation from the diodes which can result in a rapid rise in their temperature during operation, which is likely to reduce their operating life.

Furthermore, the HV outputs at the diodes of the transformer are located at different levels. For reasons of electrical safety of the transformer, a certain separation distance must be assured between the components located near the transformer and the points of connection of external HV cables to the HV outputs of the step-up coil. This distance is typically 2 to 4 cm. Consequently, the fact that the HV power supply output is generally located in the upper part of the step-up winding means that the corresponding chimney of the insulating casing surrounding the external cable must be made longer.

In order to reduce this supplementary insulating length of the cables, it is possible to move the electrical connection point further inside the insulating casing of the transformer, but this would require an additional connector (a conducting bar, for example), between the very high-voltage (VHV) output of the diode and the corresponding HV cable. This would cause additional fabrication problems of the transformer and reliability problems due to the high voltage.

In addition, in view of the high operating voltages within the transformer, the voltage strength limits of the components oblige a sufficient distance to be left between the coplanar diodes and the potentiometer block, which does not favor compactness of the transformer.

SUMMARY OF THE INVENTION

The object of the present invention, which provides a simple and effective solution to the problems described above, is a compact HV transformer with improved electrical connection characteristics and thermal dissipation.

Another object of the invention is to improve the reliability of the transformer by reducing its operating temperature, in particular near the diodes enclosed in the insulating casing.

The invention is therefore a stepped rectification high-voltage transformer including an insulating casing enclosing a primary winding and a secondary step-up winding that is mounted coaxially about the primary winding, the step-up winding having several stages each being connected to a diode, and at least two chimneys incorporated in the insulating casing and whose lower ends are each plugged by a conducting pellet that provides the electrical connection between said stages of the secondary winding and external high-voltage cables, wherein the lower ends of the chimneys are positioned substantially at the same axial level as two of said stage diodes and these two stage diodes each have one conducting end directly penetrating the lower face of the corresponding conducting pellet.

A stepped rectification high-voltage transformer, according to a preferred embodiment of the invention, comprises an insulating casing enclosing a primary winding and a secondary step-up winding that is mounted coaxially about the primary winding, the step-up winding having several stages each being connected to a diode. According to a preferred embodiment of the invention, at least two of the diodes associated with each of said stages of the secondary winding are located in the same axial plane, which enables the connections to these two output diodes to be made at the same level, thus eliminating any need for supplementary internal connecting parts.

In the case where the potentiometer block forms the front face of the insulating casing, the two diodes grouped in this manner are preferably mounted parallel to each other, symmetrically about the axis of the secondary winding and oriented perpendicularly to the inner face of the potentiometer block. When the transformer is used to supply the CRT of a television, these two grouped output diodes are preferably those corresponding to the power supply HV output and the focusing HV output.

The two grouped diodes are preferably located as low as possible within the casing, so as to bring the electrical connection points of the external HV cables further within the casing. Consequently, the height of the chimneys or the length of the resin sheathing of the cables projecting outside the casing of the transformer is reduced.

According to the invention, all the diodes of the step-up winding are advantageously located at some distance from the potentiometer block, which enables some relaxation of the voltage strength requirements of the components of the potentiometer block. This allows the potentiometer block to be moved closer to the step-up winding, reducing the overall size of the transformer in a plane perpendicular to the axis of the primary and secondary windings.

Moreover, the dispersion of the diodes of the step-up winding in the insulating casing, according to the invention, means that the heat generated by these diodes is more evenly distributed within the casing and the thermal dissipation at the diodes is thereby improved.

BRIEF DESCRIPTION OF THE DRAWINGS

The invention will be better understood on reading the following detailed description of a preferred, though non-limitative embodiment, making reference to the appended figures, of which.

Figure 1:
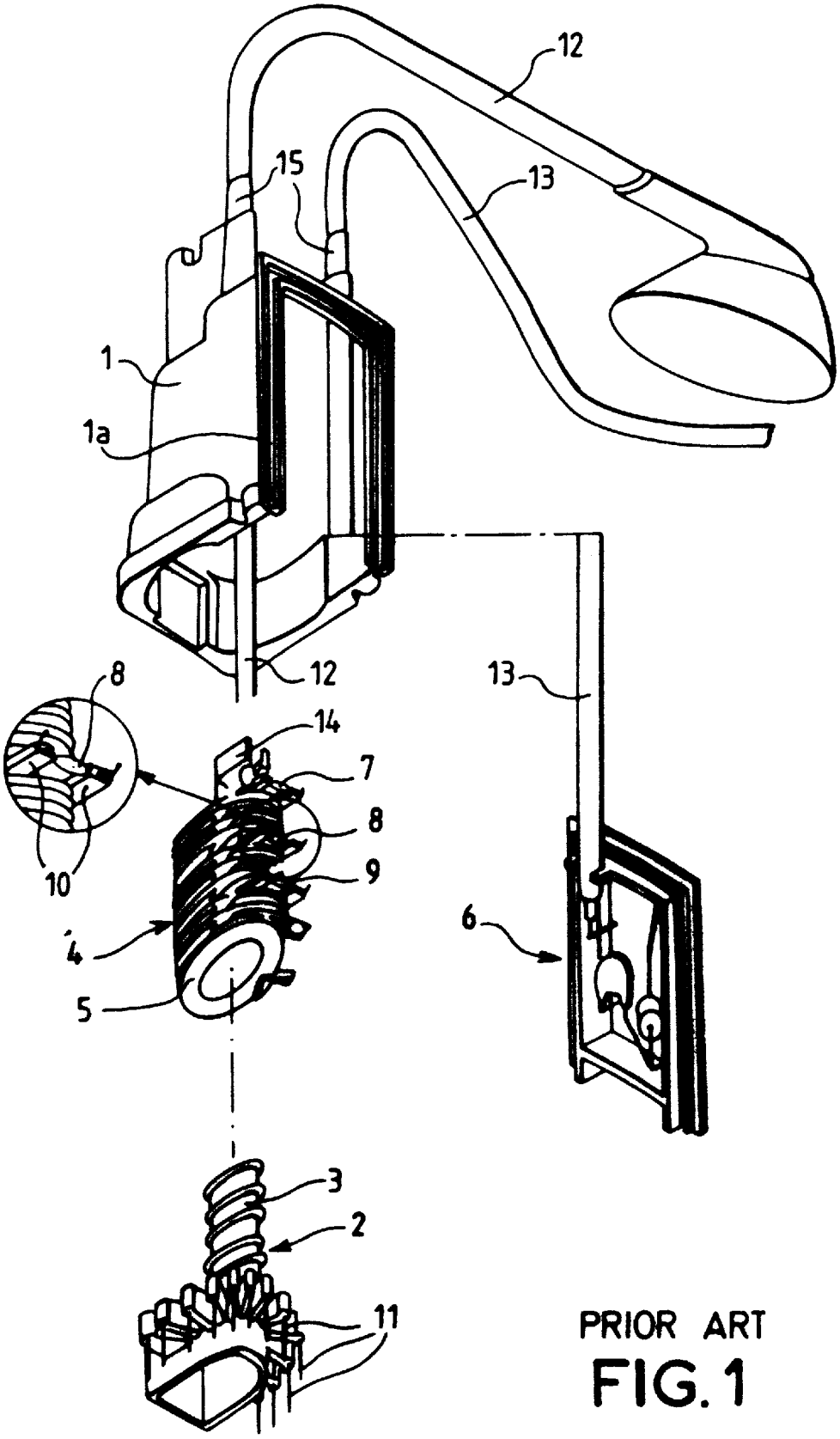
PRIOR ART FIG. 1
FIG. 1 is an exploded view of a prior-art high voltage transformer.

The high-voltage transformer shown in FIG. 1 is intended to supply the CRT of a television (not shown). The transformer includes a rigid casing 1 of electrically insulating material, a primary winding 2 wound around an insulating tubular support 3, a secondary step-up winding 4 wound around an insulating tubular support 5, a potentiometer block 6 that is removable from the front aperture 1*a* of the insulating casing 1.

Figure 2:
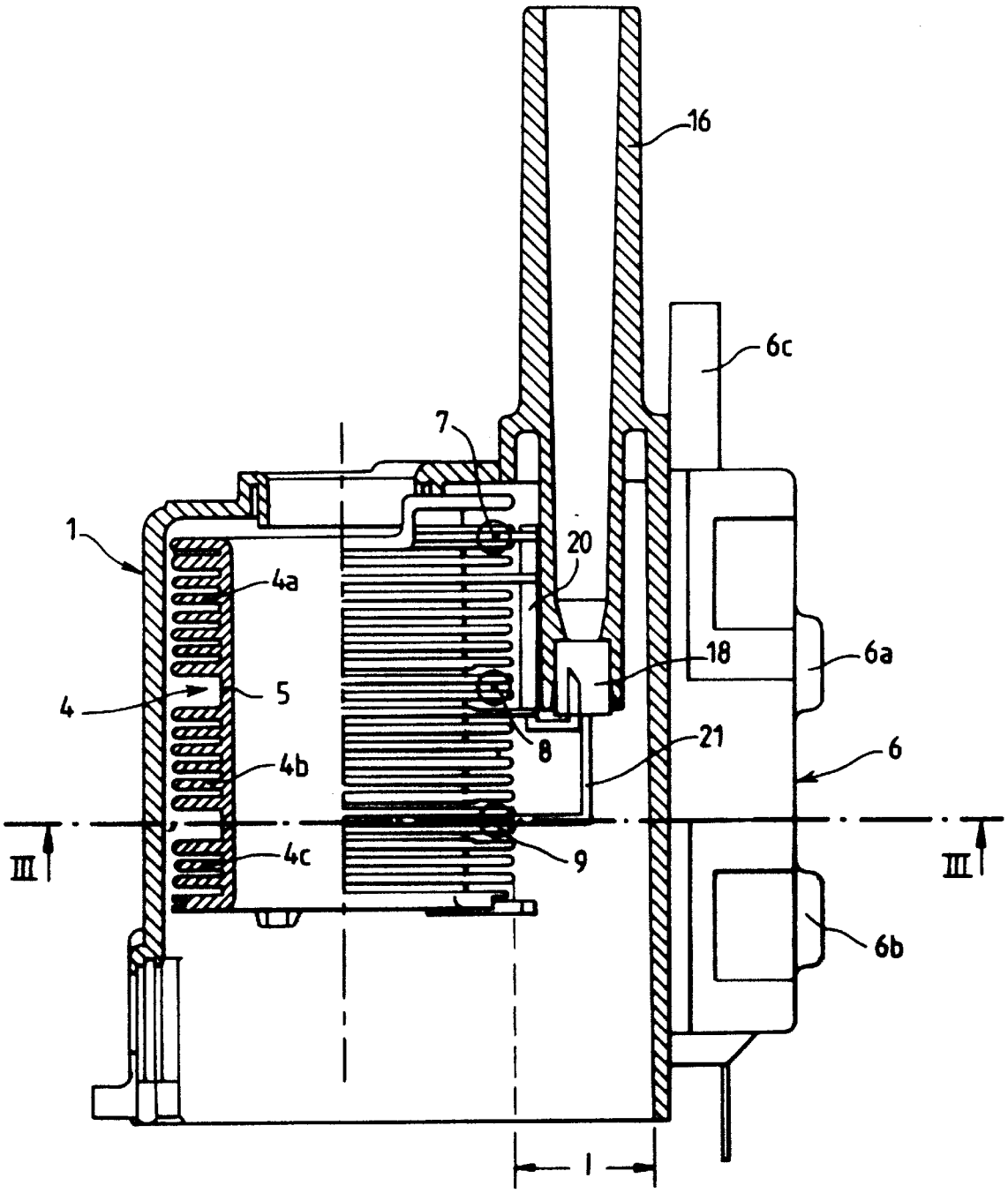
PRIOR ART FIG.2
FIG. 2 is a partial axial section along II—II of FIG. 3, showing a high voltage transformer that is a variant of that in FIG. 1.

The transformer is of the stepped rectification type, in other words it has a stepped secondary winding 4 with several HV outputs rectified by diodes. The secondary winding 4 has an upper stage 4*a,* an intermediate stage 4*b* and a lower stage 4*c* (FIG. 2). The upper diode 7 associated with the VHV output of the transformer is located above the upper stage 4*a* of the secondary winding 4. The intermediate diode 8 and the lower diode 9 respectively separate the upper stage 4*a* from the intermediate stage 4*b,* and the intermediate stage 4*b* from the lower stage 4*c* of the secondary winding 4. The lower diode 9 is associated with an HV output known as the focusing output. The diodes 7, 8, 9 are located in the same plane and supported by clip arms 10 of insulating plastic material which form part of the tubular support 5.

Electrical connectors 11 in the form of pins are connected to the primary winding 2 and possibly to auxiliary windings (not shown) which are mounted coaxially within the tubular support 3 and which provide low voltage supplies for other electrical circuits (not shown) of the television. The technique of coaxial windings (primary, secondary and auxiliary) is known, notably through the French patent n°2 632 798. The primary winding 2 is introduced coaxially into the tube 5 carrying the secondary winding 4 in order to obtain good magnetic coupling between the primary windings 2 and the secondary winding 4.

The HV cable 12 is electrically connected to the VHV output at the upper diode 7. The HV cable 13 is electrically connected to the lower diode 9 via the potentiometer block 6. The HV cable 12 is soldered to the upper diode 7 and held by a clip 14 that forms part of the insulating support 5. The cable 12 is intended to power the anode of the CRT of the television that emits a beam of electrons required for the operation of the television. The HV cable 13 connects the potentiometer block 6 of the transformer to the CRT for the purpose of focusing the electron beam emitted by the anode. The HV output at the position of the lower diode 9 is connected to the potentiometer block 6 that can be used to regulate the voltages on the HV cable 13 by means of one or two rotary knobs 6*a,* 6*b* (FIG. 2).

The insulating casing 1 must be hermetically sealed. The coplanar diodes 7, 8, 9 are mounted facing the potentiometer block 6. Electrical security required to protect neighboring circuits (not shown) against interference caused by the high voltages produced by the transformer requires that the points of electrical connection with the HV cables 12, 13 inside the insulating casing 1 be separated from the exterior by a certain distance. In practice, the HV cables 12, 13 are sheathed in an insulating resin 15 up to a predetermined height beyond the top of the casing 1 of the transformer. The height of this resin sheathing 15 depends on the value of the output voltages.

Figure 3:
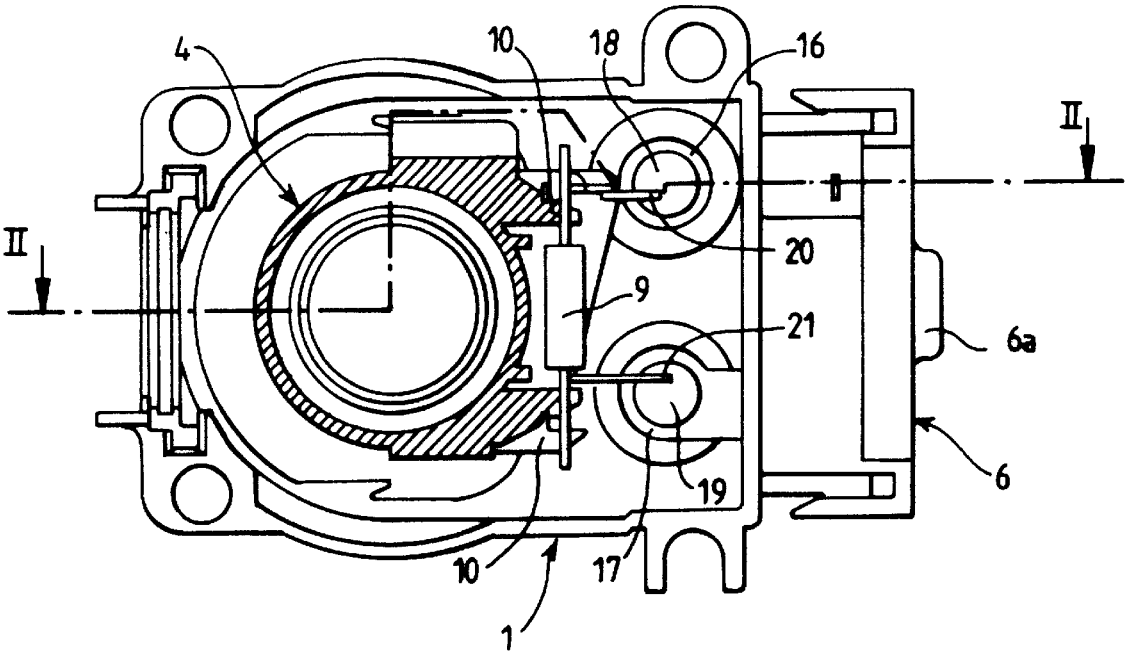
PRIOR ART FIG. 3
FIG. 3 is a partial radial section of the transformer along III—III of FIG. 2.

FIGS. 2 and 3 show a known variant of the HV transformer, which differs from the one in FIG. 1 essentially as regards the electrical connections between the HV outputs of the secondary winding 4 and the HV cables 12, 13. In order to simplify the description, the same parts of the transformer shown in different figures carry the same reference number.

As shown in FIGS. 2 and 3, the HV transformer includes an insulating casing 1 incorporating two chimneys 16, 17 that project from the casing 1 and that are intended to receive the HV cables 12, 13 (shown in FIG. 1, but not in FIGS. 2 and 3). The chimneys 16, 17 replace the insulating sheathing 15 of FIG. 1 as a means of assuring the required electrical safety. The chimneys 16, 17 also project within the casing 1 and their lower ends are each plugged by a silicone pellet 18, 19 containing conducting powder. The electrical connection technique making use of conducting pellets is described in detail in the European patent n°0 236 642.

The HV cables 12, 13 (not shown in FIGS. 2 and 3) have a rigid core that can be pushed into the upper face of the conducting pellets 18, 19 in the chimneys 16, 17. The electrical connections between the conducting pellets 18, 19 and the step-up coil outputs (VHV power outputs and HV focusing output) are assured by a rigid conductor pushed into the lower faces of the conducting pellets 18, 19. Since the upper diode 7 and lower diode 9 associated with these two HV outputs are located at different levels, conducting connector bars 20, 21 must be provided to make the connection with these diodes, respectively 7 and 9, the ends of these connector bars being pushed into the lower faces of the conducting pellets 18, 19 associated with the external HV cables 12, 13.

The potentiometer block 6 is mounted on the front face of the insulating casing 1 and has two rotary knobs 6*a*, 6*b* used to adjust two output voltages (electron beam acceleration and focusing) in a known manner. The potentiometer block 6 includes a small chimney 6 for the output of an auxiliary cable (not shown). In this configuration, the chimneys 16, 17 of the transformer are located near the front face of the insulating casing 1. The diodes 7, 8, 9 respectively associated with the upper stage 4*a,* intermediate stage 4*b* and lower stage 4*c* of the secondary winding 4 are located in a plane also facing the front face of the insulating casing 1, this plane being parallel to the circuit board of the potentiometer block 6. Since the potentiometer block 6 is mounted on this front face, the problem of the voltage strength of the various components arises. More precisely, the distance I separating the diodes 7, 8, 9 from the potentiometer block 6 must be sufficiently great to avoid all risk of electrical arcing due to the high output voltages, a phenomenon which could destroy the transformer.

In addition, the connector bars 20, 21 are difficult to assemble and, in view of the high voltages they carry, their positioning also poses a problem. What is more, these bars 20, 21 take up valuable space inside the insulating casing 1. The fact that the diodes 7, 8, 9 are aligned and located in the confined space near the potentiometer block 6 also creates a problem of dissipation of the heat generated by these diodes. The concentration of heat around these diodes could rapidly affect their functional characteristics during prolonged use of the transformer.

Figure 4:
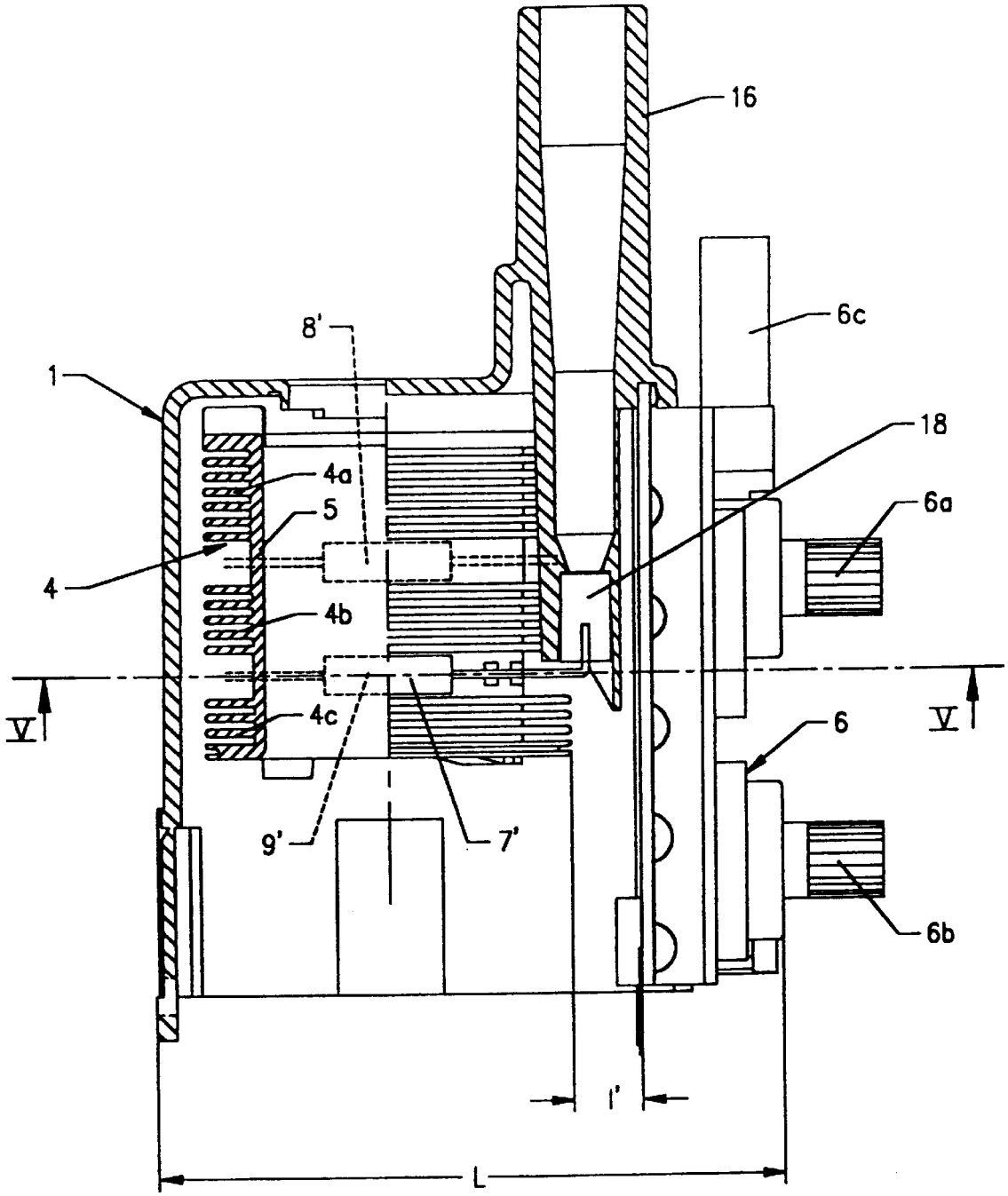
FIG. 4 is a partial axial section along IV—IV of FIG. 5, showing a high voltage transformer according to the invention.
Figure 5:
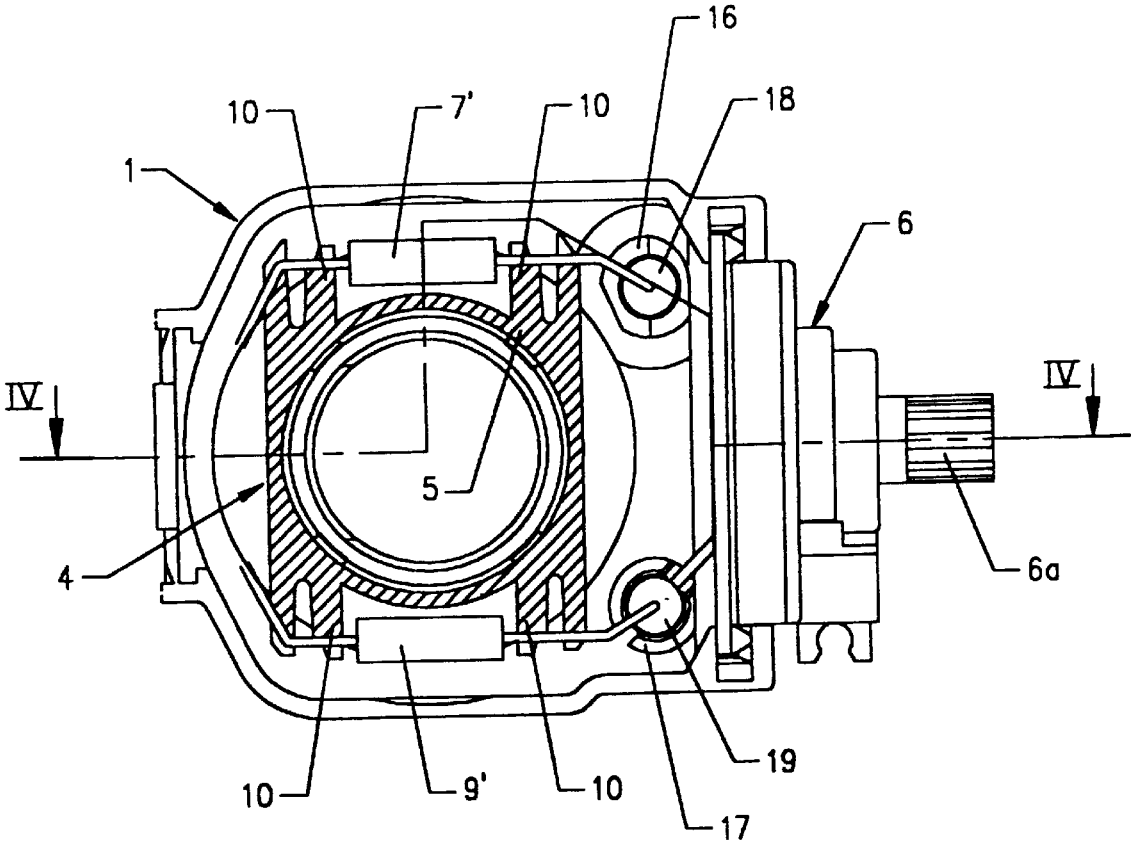
FIG. 5 is a partial radial section of the transformer along V—V of the transformer in FIG. 4.

FIGS. 4 and 5 show an example of an embodiment of the HV transformer according to the invention. The example is given for purposes of comparison with the variant of the prior-art transformer shown in FIGS. 2 and 3.

The secondary winding 4 still includes three stages 4*a,* 4*b* and 4*c* with three associated diodes 7', 8', 9'. The intermediate diode 8' and the lower diode 9' lie in the same plane parallel to the axis of the windings and are perpendicular to the front face of the insulating casing 1 constituted by the potentiometer block 6. The diode 7' associated with the upper stage 4*a* for the VHV output is located in the same radial plane as the lower diode 9', the two diodes being mounted symmetrically about the axis of the tubular support 5.

The diodes 7, 8', 9' are held by means of clip arms 10 in a known manner. To assure the electrical connection between the diode 7' and the upper stage 4*a,* the conductor of the upper stage 4*a* is prolonged downwards and connected to one of the ends of the diode associated with it. The intermediate diode 8' lies in the same plane parallel to the axis as the lower diode 9'. By positioning the diodes 7', 8', 9' in this manner the height of the insulating tubular support 5 of the secondary winding 4 can be made shorter. It also assures better distribution of heat within the insulating casing 1, and therefore better dissipation of the heat generated by the diodes and more reliable operation. The risk of electrical arcing is minimized since the diodes are no longer in the immediate vicinity of the potentiometer block 6. It is then possible to move the secondary winding 4 to a distance I' (FIG. 4) from the potentiometer block 6 constituting the front face of the insulating casing 1, this distance being significantly less than the distance I (FIG. 2) in the prior-art transformer. The width of the insulating casing 1 can be reduced, thereby minimizing the overall width L (FIG. 4) of the transformer.

The positioning of diodes 7', 8', 9' according to the invention also enables elimination of the supplementary connector bars 20, 21 used to make the electrical connections to the outputs of the secondary winding 4 in the prior-art transformer. Ends of the diode 7' associated with the upper stage 4*a* of the secondary winding4 and of the diode 9' associated with the lower stage 4*c* are parallel to each other and are used to make direct connections to the conducting pellets 18, 19 of the chimneys 16, 17. These conducting ends of the diodes are sufficiently robust to be bent and pushed respectively into the lower face of the conducting pellets 18, 19. Such a connection is extremely simple and improves the electrical performance of the transformer by eliminating any interference phenomena resulting from the assembly or the positioning of the connector bars 20, 21.

Furthermore, the configuration according to the invention enables the lower ends of the chimneys 16, 17 to be brought down the level of the output diodes 7' and 9', which means that the chimneys are moved further into the insulating casing 1, thereby reducing the overall height of the transformer.

The invention is not, of course, limited to a secondary winding having three stages. For a larger number of stages, we can group at least two output diodes at a given level and possibly group other diodes at other levels, in planes perpendicular to the circuit board of the potentiometer block.

What is claimed is:

1. Stepped rectification high-voltage transformer comprising:

an insulating casing enclosing a primary winding and a secondary step-up winding wound about an insulating support that is mounted coaxially about the primary winding, said casing having a substantially flat front face, the secondary step-up winding having several stages each being connected to a diode, each of said diodes being held by said insulating support, a potentiometer block mounted on said front face of said insulating casing, and at least two of said diodes being mounted with their longitudinal axes being substantially parallel to each other, symmetrically about the axis of said secondary step-up winding and substantially perpendicular to said front face of said insulating casing.

2. High-voltage transformer according to claim 1, used to power a television cathode ray tube, wherein said two diodes provide the very-high voltage output used by the anode of the cathode ray tube and the high-voltage output used for focusing the cathode ray tube.

3. The stepped rectification high-voltage transformer as recited in claim 1 wherein said insulating casing has at least two chimneys having lower ends each plugged by a pellet made of silicone-containing conductive powder that provides an electrical coupling between said stages of the secondary step-up winding and external high voltage cables, the lower ends of the chimneys being positioned substantially at the same axial level as two of said diodes, and the two diodes each having one conducting end directly penetrating the lower face of the corresponding pellet.

* * * * *